US010251498B1

(12) United States Patent
Feldman et al.

(10) Patent No.: US 10,251,498 B1
(45) Date of Patent: Apr. 9, 2019

(54) FITTED SHEET HAVING EXPANDABLE CORNER SEGMENTS

(71) Applicant: GHCL Limited, Uttar Pradesh (IN)

(72) Inventors: Nancy Feldman, Woodbury, NY (US); Sunil Ghalsasi, Mumbai (IN)

(73) Assignee: GHCL Limited, Uttar Pradesh (IN)

( * ) Notice: Subject to any disclaimer, the term of this patent is extended or adjusted under 35 U.S.C. 154(b) by 0 days.

(21) Appl. No.: 15/987,303

(22) Filed: May 23, 2018

(51) Int. Cl.
*A47G 9/02* (2006.01)

(52) U.S. Cl.
CPC ..... *A47G 9/0246* (2013.01)

(58) Field of Classification Search
CPC ..... A47C 31/105; A47G 9/02; A47G 9/0238; A47G 9/0246
See application file for complete search history.

(56) References Cited

U.S. PATENT DOCUMENTS

| | | | | |
|---|---|---|---|---|
| 2,624,893 | A | 1/1953 | Harris | |
| 4,980,941 | A | 1/1991 | Johnson, III | |
| 6,983,500 | B2 | 1/2006 | Wootten | |
| D673,411 | S * | 1/2013 | Roberts | D6/605 |
| 9,820,592 | B2 | 11/2017 | Feldman | |
| 2012/0054962 | A1 * | 3/2012 | Agarwall | A47G 9/0246 5/497 |

* cited by examiner

*Primary Examiner* — Nicholas F Polito
(74) *Attorney, Agent, or Firm* — Buchanan Ingersoll & Rooney PC

(57) ABSTRACT

A fitted sheet is disclosed which will fit either of two mattresses of different sizes without undue wrinkling or bunching of fabric. This fitted sheet has an elastic segment at each corner. Each elastic segment is attached to the top panel, one of the side panels and either the front panel or the rear panel of the fitted sheet. The elastic segments are substantially similar in size and shape and are stretchable in two directions. Each elastic segment also has a seam extending from the straight upper edge portion toward the free lower edge that defines a corner in the elastic segment when the elastic segment is in a relaxed condition. The corner is between the upper edge and the lower edge of the elastic segment.

10 Claims, 6 Drawing Sheets

FITTED SHEET HAVING EXPANDABLE CORNER SEGMENTS

FIELD OF THE INVENTION

The present invention relates to a fitted sheet for a mattress, and in particular to a fitted sheet that will cover either of two mattresses of different sizes.

BACKGROUND OF THE INVENTION

Fitted sheets are typically configured to cover a substantial portion of a mattress and engage the mattress to obviate undesired movement of the fitted sheet. Typically, fitted sheets are provided with at top panel, side panels extending from the edges of the top panel and elastic along all of the exposed edges of the side panels or along the exposed edges of two opposite side panels. The side panels are sized so that a portion of the side panels can be tucked underneath the mattress and held in place by the elastic.

Mattresses are sold in several sizes. The most common sizes are twin, twin XL, double (also called full size), queen, king and California king. Most fitted sheets available in the market are made to fit one size mattress. U.S. Pat. No. 9,820,592 B2 discloses a fitted sheet that is made to fit both a twin mattress and a twin XL mattress. This fitted sheet as elastic strips in the corners which stretch in only one direction.

The art has recognized that one can make the corners of a fitted sheet to contain elastic threads so that the sheet will fit more securely on a mattress. U.S. Pat. No. 2,624,893 discloses a sheet for a crib in which elastic threads are provided. These threads run in a single direction from the exposed edge of the sheet toward the top panel. U.S. Pat. No. 4,980,941 discloses a fitted bedding product in which portions of the side panels are made of an elastic material.

When fitted sheets fit only one size of a mattress retailers and wholesalers must stock a sufficiently large inventory to have a fitted sheet in at least the most popular colors that fits each of the commonly available mattresses. It also forces purchasers to buy specifically-sized fitted sheets for each size of mattress in their household or establishment. Wooten recognized this problem and attempted to solve the problem by providing a fitted sheet disclosed in his U.S. Pat. No. 6,983,500 B2. That product includes a top portion, opposite side portions, opposite end portions, and elastic segments connected between adjacent edges of respective side and end portions. Wooten teaches that each of the segments is a flat piece of material having an attached edge that may have an ellipse shape, a circular shape or a crescent shape and a free straight edge. FIGS. 1 and 2 of the patent show one embodiment that is fitted snugly on a full size mattress and FIGS. 3 and 4 show the same fitted sheet snugly fitted on a queen size mattress. However, we made a fitted sheet as taught by the '500 patent which fit snugly on a queen mattress as shown in FIGS. 3 and 4 of the patent. However, when we put the same sheet on a full size mattress the corners and the side panels were loose and wrinkled.

We also made a sheet in accordance with the teaching of U.S. Pat. No. 4,980,941 that snugly fit a queen mattress and another sheet according to the teaching of U.S. Pat. No. 2,624,893 that snugly fit a queen mattress. When we put each of these sheets on a full size mattress, both of them did not fit the full size mattress. The corners and the side panels were loose and wrinkled.

There is still a need for a fitted sheet that will fit on each of two mattresses that are different in size, such as a full and a queen, or a king and a California king. A need also exists for fitted sheets that, when mounted on a mattress, will have no seam ears or pockets at their corners.

SUMMARY OF THE INVENTION

We provide a fitted sheet which will fit either of two mattresses of different sizes without undue wrinkling or bunching of fabric. This fitted sheet has a first side panel, a second side panel, a front panel and a rear panel, all attached to a top panel. An elastic segment is provided at each corner. Each elastic segment is attached to the top panel, one of the side panels and either the front panel or the rear panel. The elastic segments are substantially similar in size and shape. Each elastic segment has an upper edge having a straight upper edge portion that is connected to the top panel, a first side that is connected to the one of the front panel and the rear panel and a second side that is connected to one of the first panel and the second panel and a free lower edge opposite the upper edge. Each elastic segment also has a stitched seam extending from a mid-point of the straight upper edge portion toward the free lower edge and defining a corner in the elastic segment when the elastic segment is in a relaxed condition. The corner is between the upper edge and the lower free edge. The elastic segments are stretchable in a first direction along a line between the upper edge and the lower edge and stretchable in a second direction along a line between the first side and the second side. Like the conventional fitted sheet our sheet also has elastic along the free edge of the side panels, front panel and rear panel.

We prefer that the elastic segments are made of a single sheet of spandex material. Other materials that can stretch in both a horizontal direction and a vertical direction can be used.

Other objects, aspects, features, advantages, and possible applications of the present invention will be more apparent from the following more particular description of certain present preferred embodiments shown in the drawings.

DETAILED DESCRIPTION OF THE PREFERRED EMBODIMENTS

Figure 1:
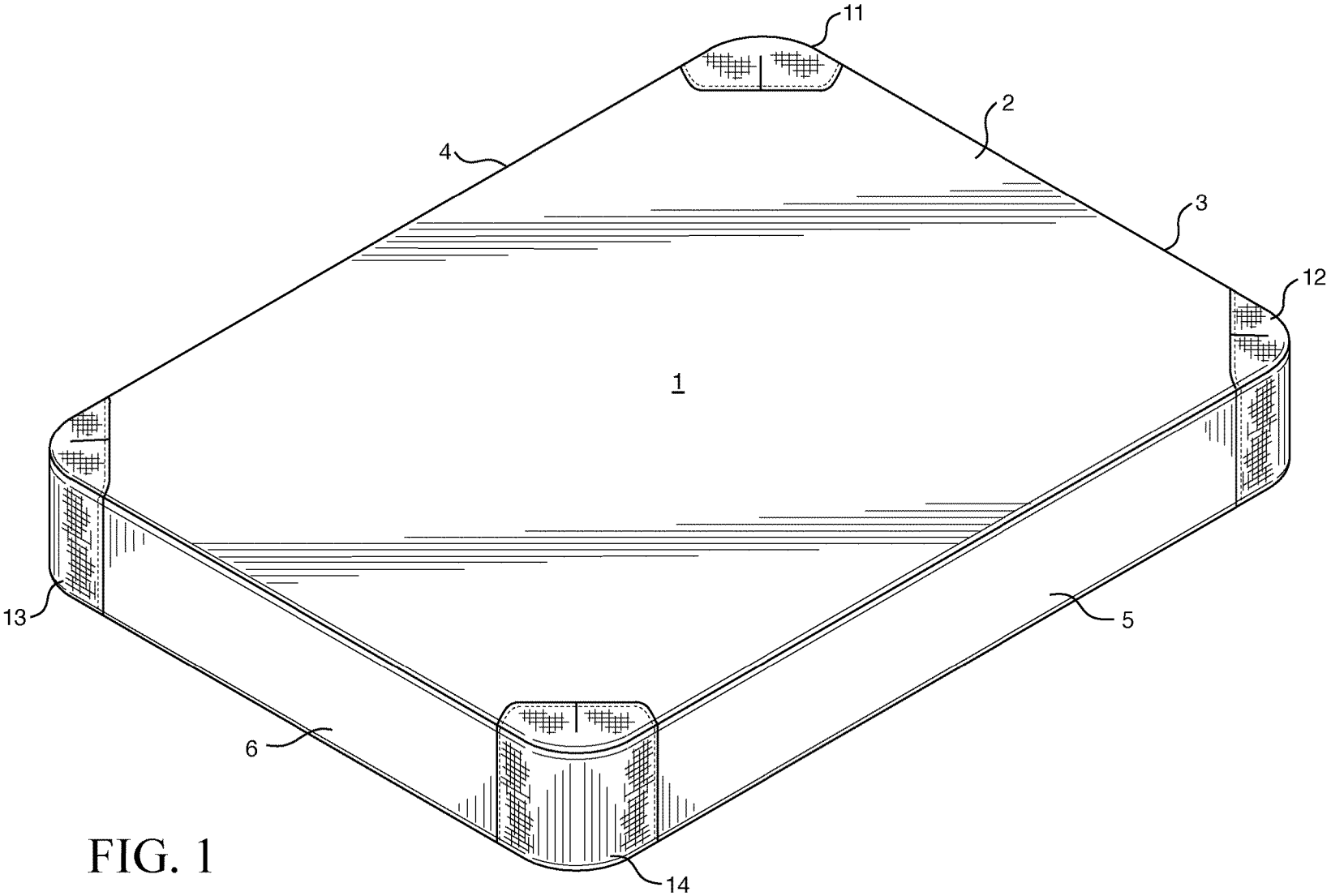
FIG. 1 is a perspective view of a present preferred embodiment of the fitted sheet on a queen size mattress.
Figure 2:
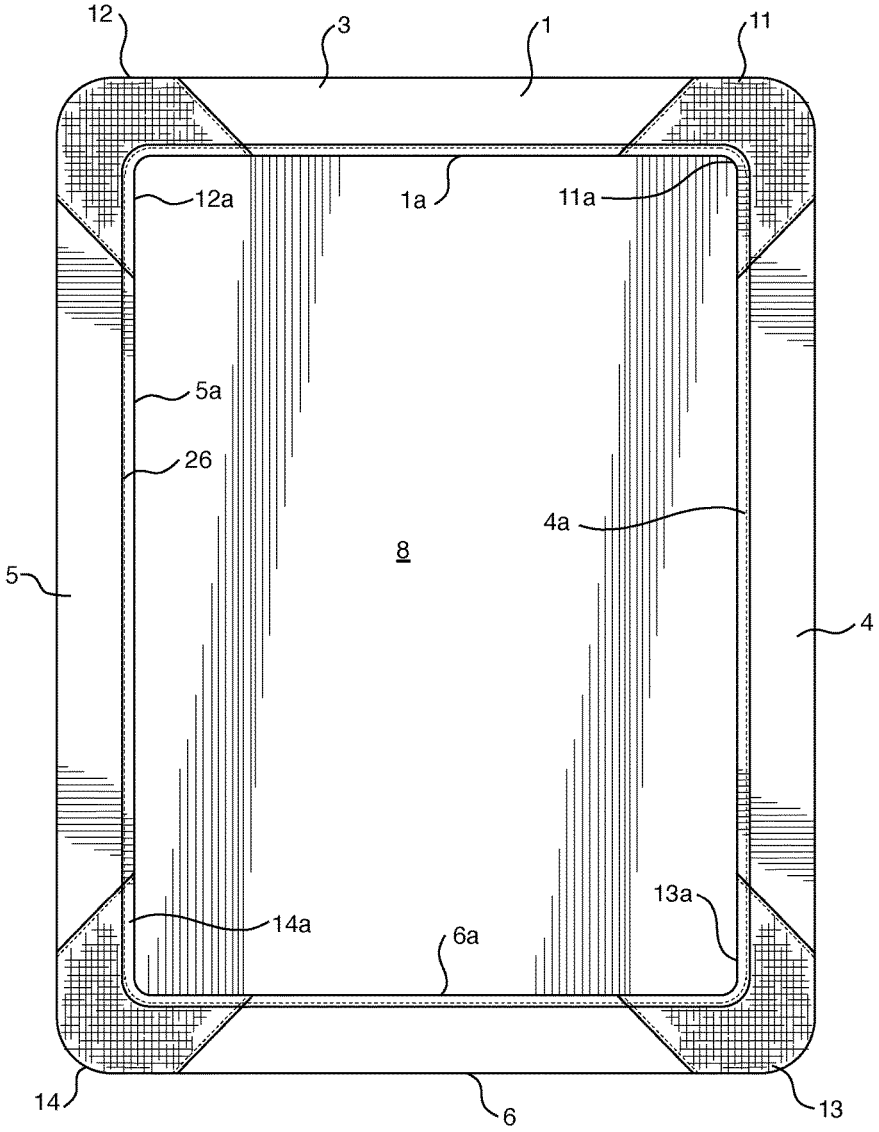
FIG. 2 is bottom view of the fitted sheet shown in FIG. 1.
Figure 3:
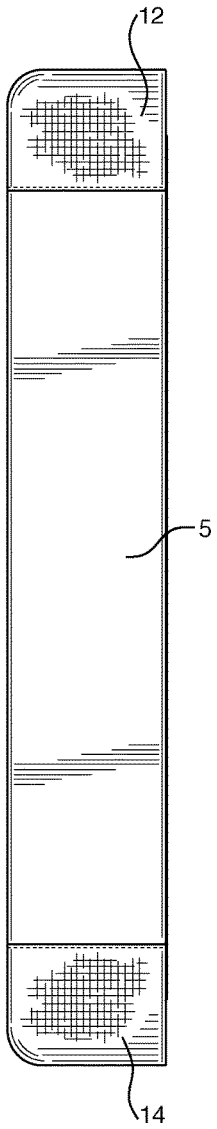
FIG. 3 is a side view of the fitted sheet shown in FIG. 1.
Figure 4:
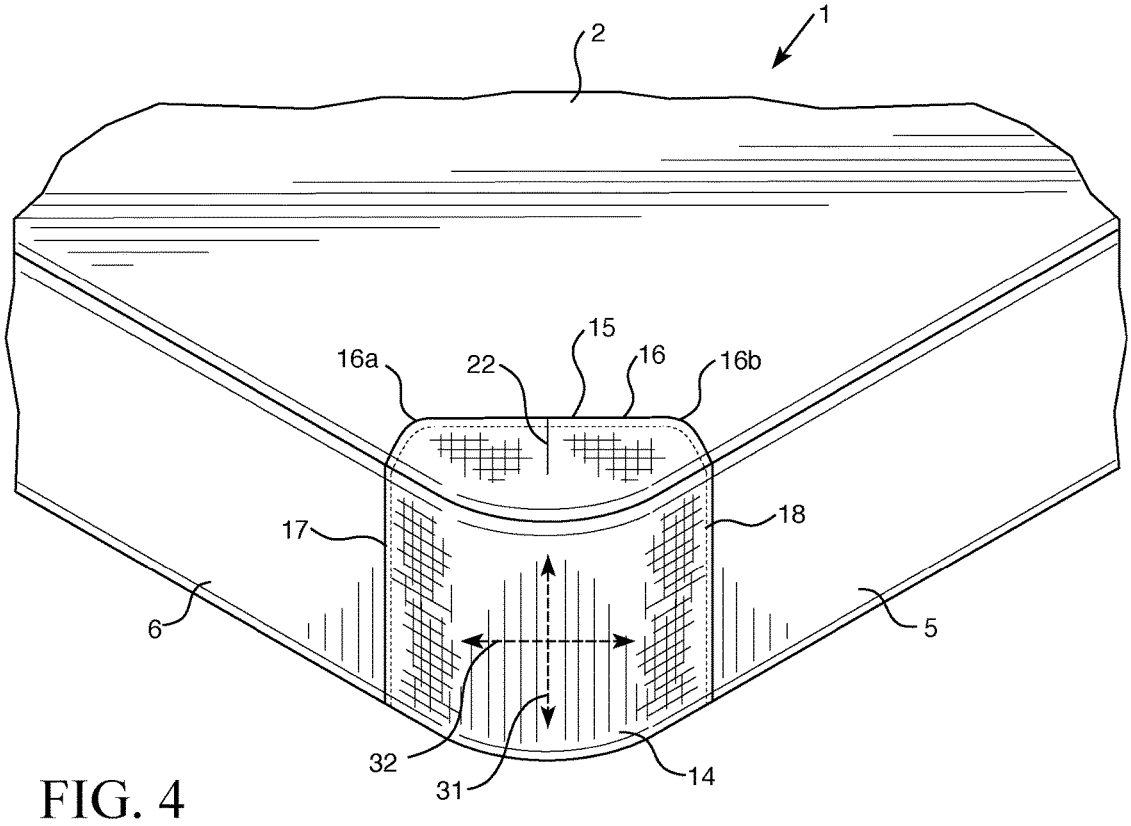
FIG. 4 is an enlarged perspective view of the corner of the fitted sheet shown in FIG. 1

We provide a fitted sheet 1 shown in FIGS. 1 through 4 on a queen size mattress 8 and shown in FIGS. 5 through 8 a on a smaller full size mattress 9. The fitted sheet has a top panel 2, a front panel 3, a first side panel 4, a second side panel 5 and a rear panel 6. Preferably all of these panels are one integral piece of fabric, like most conventional fitted sheets. The fabric may be cotton, cvc cotton, which contains both cotton threads and polyester threads, cotton blends, 100% Tencel® material (a fabric made of fiber strands from wood pulp manufactured by Lenzing AG), modal material (a fabric made of a semi-synthetic cellulose fiber made by spinning reconstituted cellulose, often from beech trees), linen, or other material from which bed sheets can be made. Typically the panels will be a single ply material, but may consist of two or more layers of the same or different materials.

There is a first elastic segment 11 connected at a junction of the top panel 2 the front panel 3 and the first side panel 4. A second elastic segment 12 is connected at a junction the top panel 2, the front panel 3 and the second side panel 5. A third elastic segment 13 is connected at a junction of the top panel 2, the rear panel 6 and the first side panel 4. A fourth elastic segment 14 is connected at a junction of the top panel 2, the rear panel 6, and the second side panel 5. All of the elastic segments have substantially the same shape. As can be seen most clearly in FIGS. 4 and 8, each elastic segment has an upper edge 15 having a straight upper edge portion 16, a first curved end 16*a* and a second curved end 16*b*. The upper edge 15 is connected to the top panel 2. There is a first side 17 that is connected to the front panel 3 or the rear panel 6 and a second side 18 that is connected to one of the first panel 5 the second panel 6. Each elastic segment also has a free lower edge opposite the upper edge 15.

Figure 5:
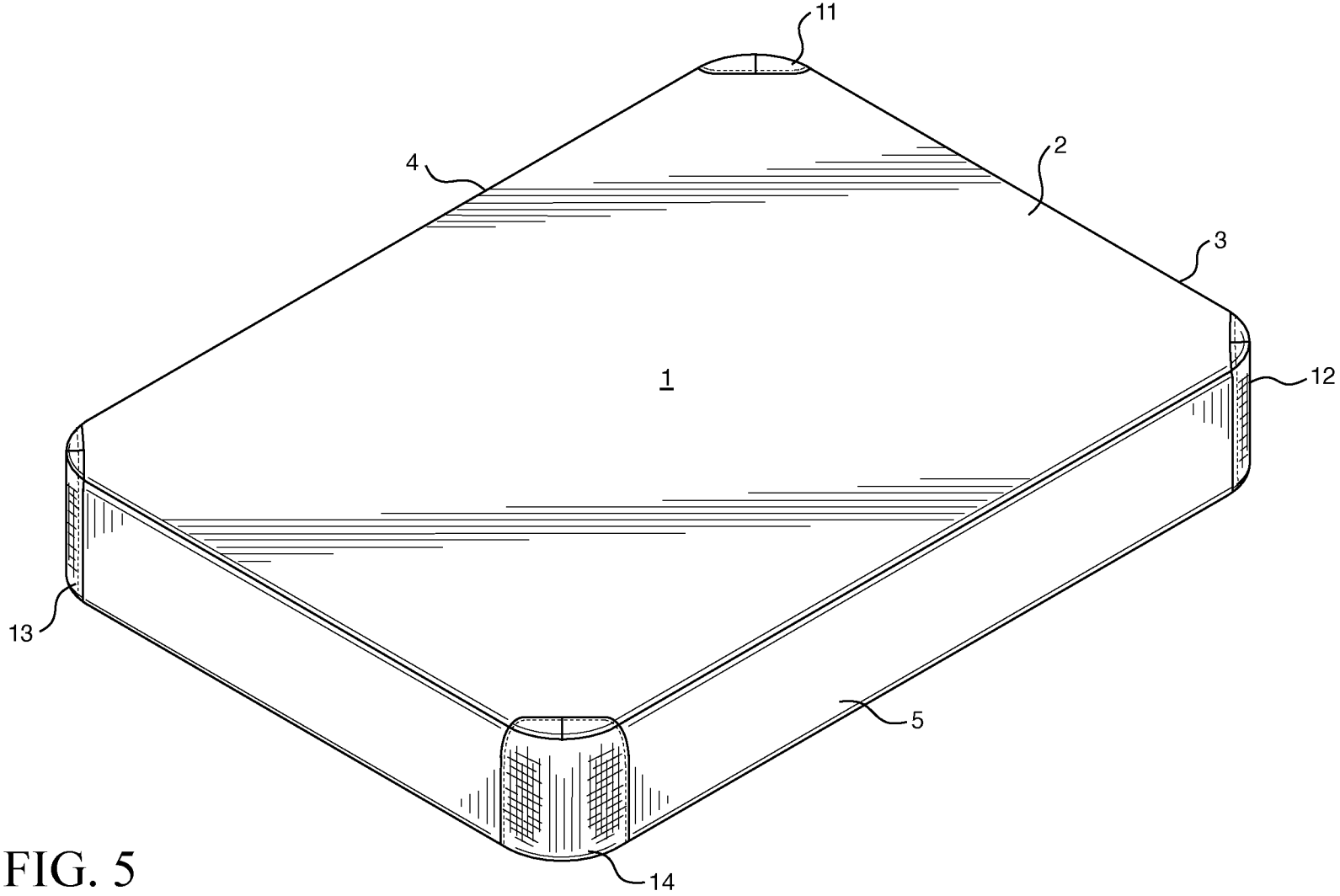
FIG. 5 is a perspective view of the present preferred embodiment of the fitted sheet shown in FIGS. 1 through 4 on a full size mattress.
Figure 6:
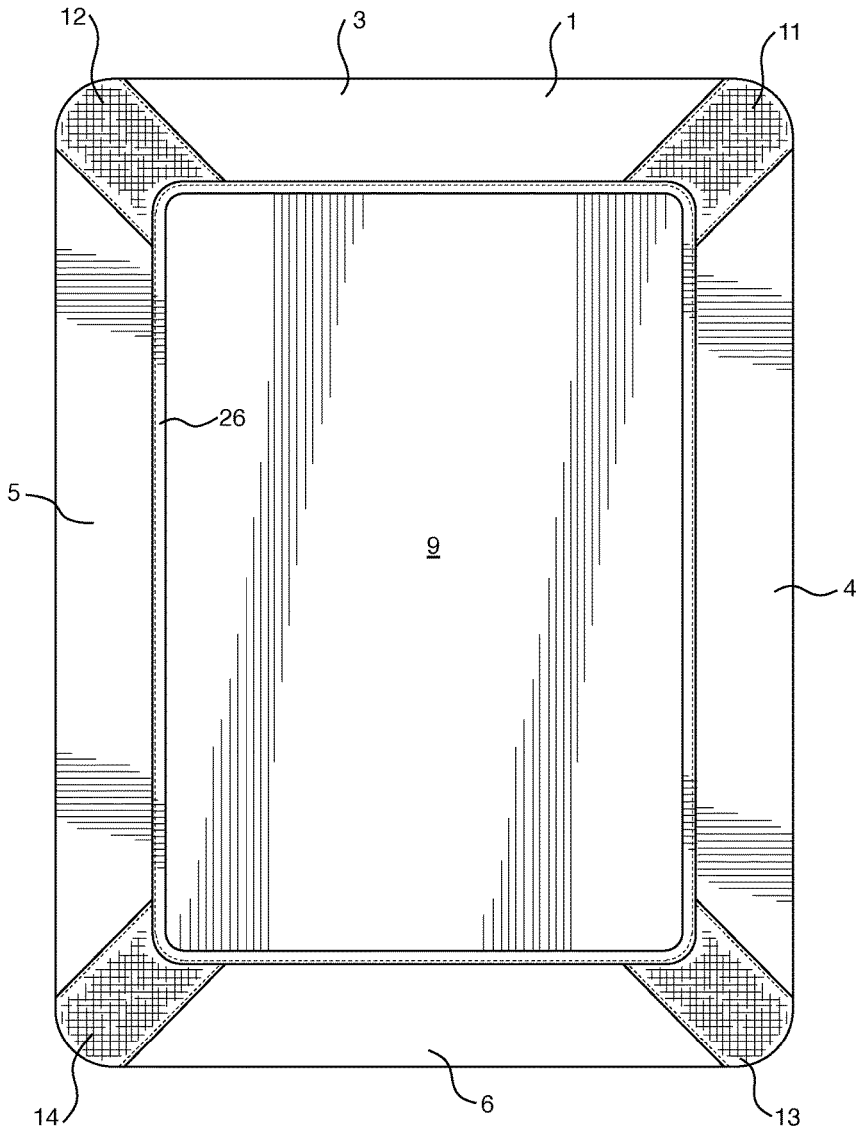
FIG. 6 is bottom view of the fitted sheet as shown in FIG. 5.
Figure 7:
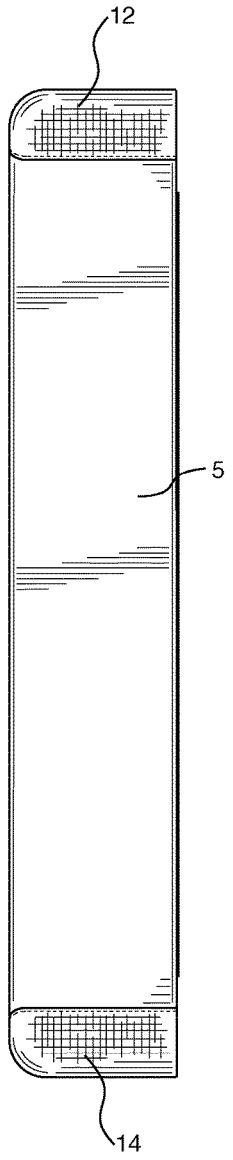
FIG. 7 is a side view of the fitted sheet shown in FIG. 5.
Figure 8:
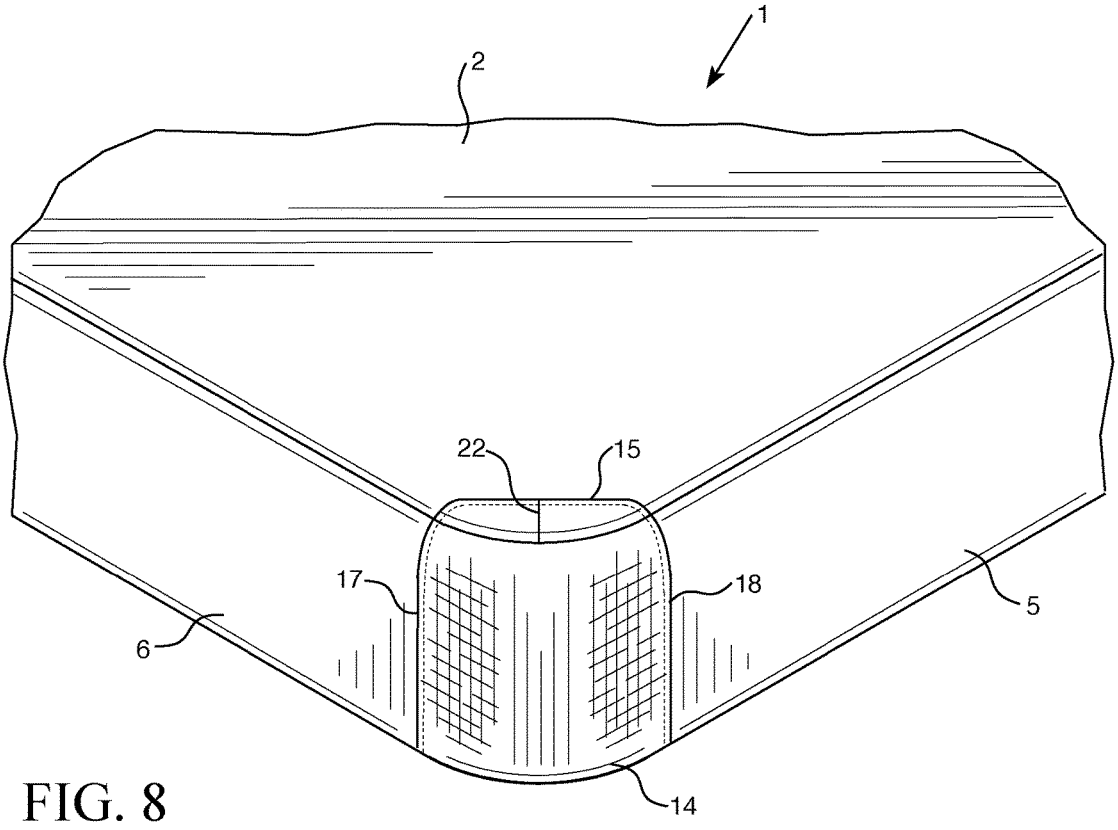
FIG. 8 is an enlarged perspective view of the corner of the fitted sheet shown in FIG. 5.

We also provide a seam 22 extending from a mid-point of the straight upper edge portion 16 of the upper edge 15 of the elastic segment. The seam 22 extends toward the lower edge of the elastic segment. This construction forms a corner in the elastic segment when the elastic segment is in a relaxed condition. The corner is at the end of the seam 22. When the fitted sheet in on the smaller mattress this corner is at or close to a corner of the mattress as can be seen in FIGS. 5 and 8. When the fitted sheet is on the larger mattress the corner is on the top of the mattress, but has been flattened because of the elastic material that we use for the corner segments. The elastic segments are stretchable in a first direction, indicated by arrow 31 in FIG. 4, between the upper edge and the lower edge and stretchable in a second direction, indicated by arrow 32 in FIG. 4, between the first side and the second side. These lines are shown as arrows in FIGS. 4 and 8. The combination of the seam and a fabric that stretches both horizontally and vertically when the sheet is on a mattress enables the elastic segments to snuggly fit the smaller mattress without forming an ear or unsightly wrinkles.

Finally, we prefer to provide elastic 26 attached to the exposed edges of the front panel, rear panel and elastic segments. Alternatively, the elastic can be on only the front panel and the rear panel or only on the side panels. This elastic functions like the elastic on the edge of a conventional fitted sheet.

We made a fitted sheet like that shown in the drawings which fits snugly on both a full size mattress and a queen size mattress. This top panel, side panes, front panel and rear panel were made of cotton and the elastic segments were made of spandex. When this fitted sheet is placed on a queen size mattress, the length of the side panels as measured along the edges 4*a* and 5*a* in FIG. 2 was 63.5 inches (1613 mm). The length of both the front panel and the rear panel as measured along the edges 3*a* and 6*a* in FIG. 2 was 43.25 inches (1099 mm). The length of the each of the edges 11*a*, 12*a*, 13*a* and 14*a* of the elastic segments while the elastic segments were on the queen side mattress was 5 inches (127 mm). The stitched seam 22 in FIG. 1 was 2.5 inches (63.5 mm) long. Sides 17 and 18 were 18.5 inches (470 mm) from the curved portion 16*a*, 16*b* to the bottom edge 11*a*, 12*a*, 13*a* and 14*a* of each elastic segment 11, 12, 13 and 14 while the elastic segment was on the queen size mattress. By changing these dimensions one skilled in the art could make a fitted sheet that will fit both a king size mattress and a California king size mattress. Consequently, a retailer desiring to offer one style and color of a fitted sheet for a full size mattress, a queen mattress, a king mattress and a California king mattress need only inventory two units of our fitted sheet, rather than four units of a conventional fitted sheet. It should also be apparent to one skilled in the art that our fitted sheet could be sized to fit a queen size mattress or a king size mattress.

Although we have shown and described certain present preferred embodiments of our fitted sheet, it should be distinctly understood that our invention is not limited thereto but may be variously embodied within the scope of the following claims.

We claim:

1. A fitted sheet comprising:

a top panel having a length and a width;

a first side panel attached to the top panel and having an exposed edge;

a second side panel attached to the top panel and having an exposed edge;

a front panel attached to the top panel, the first side panel and the second side panel, the front panel having an exposed edge;

a rear panel attached to the top panel, the first side panel and the second side panel, the rear panel having an exposed edge;

a first elastic segment connected at a junction of the top panel the front panel and the first side panel;

a second elastic segment connected at a junction the top panel, the front panel and the second side panel;

a third elastic segment connected at a junction of the top panel, the rear panel and the first side panel; and a fourth elastic segment connected at a junction of the top panel, the rear panel, and the second side panel;

wherein the first elastic segment, the second elastic segment, the third elastic segment and the fourth elastic segment are substantially similar in size and shape, each elastic segment having an upper edge having a straight upper edge portion that is connected to the top panel, a first side that is connected to the one of the front panel and the rear panel and a second side that is connected to one of the first panel and the second panel and a free lower edge opposite the upper edge;

wherein each elastic segment has a stitched seam extending from the straight upper edge portion toward, but not to, the free lower edge and ending at an endpoint within the elastic segment, the stitched seam defining a corner at the endpoint in the elastic segment when the elastic segment is in a relaxed condition, the corner being between the upper edge and the lower edge; and wherein the elastic segments are stretchable in a first direction along a line between the upper edge and the lower edge and stretchable in a second direction along a line between the first side and the second side.

2. The fitted sheet of claim 1 also comprising elastic attached to at least one of the exposed edge of the first side panel, the exposed edge of the second side panel, the exposed edge of the front panel, and the exposed edge of the rear panel.

3. The fitted sheet of claim 1 wherein the upper edge of each elastic segment is also comprised a first curved end and a second curved end, the straight upper edge portion being between the first curved end and the second curved end.

4. The fitted sheet of claim 1 wherein the stitched seam extends from a mid-point of the straight upper edge portion.

5. The fitted sheet of claim 1 wherein the exposed edge of the first side panel and the exposed edge of the second side panel have a same length.

6. The fitted sheet of claim 5 wherein the same length is 63.5 inches.

7. The fitted sheet of claim 1 wherein the exposed edge of the front panel and the exposed edge of the rear panel have a second same length.

8. The fitted sheet of claim 7 wherein the second same length is 43.25 inches.

9. The fitted sheet of claim 1 wherein the top panel, side panels, front panel and rear panels contain fibers selected from the group consisting of cotton, cotton blends, wood pulp based fibers and semi-synthetic cellulose fibers made by spinning reconstituted cellulose.

10. The fitted sheet of claim 1 wherein the elastic segments are comprised of spandex.

* * * * *